US007451683B2

(12) United States Patent
Kellermann et al.

(10) Patent No.: US 7,451,683 B2
(45) Date of Patent: Nov. 18, 2008

(54) PISTOL

(75) Inventors: Harald Kellermann, Eckernförde (DE); Adrian Thomele, Holtsee (DE)

(73) Assignee: J.P. Sauer & Sohn GmbH, Eckernforde (DE)

( * ) Notice: Subject to any disclaimer, the term of this patent is extended or adjusted under 35 U.S.C. 154(b) by 224 days.

(21) Appl. No.: 11/291,082

(22) Filed: Nov. 30, 2005

(65) Prior Publication Data

US 2006/0156608 A1 Jul. 20, 2006

(30) Foreign Application Priority Data

Dec. 18, 2004 (EP) ..... 04030087

(51) Int. Cl.
*F41A 3/86* (2006.01)
*F41A 19/00* (2006.01)

(52) U.S. Cl. ..... 89/196; 89/194; 89/195; 42/69.01; 42/69.02; 42/75.02

(58) Field of Classification Search ..... 89/194–196, 89/197; 42/69.01, 69.02, 71.01, 75.02
See application file for complete search history.

(56) References Cited

U.S. PATENT DOCUMENTS 992,854 A * 5/1911 Cobb ..... 89/147
1,294,506 A * 2/1919 Martin ..... 89/144
2,468,784 A 5/1949 Seagraves
3,195,408 A * 7/1965 Sherman ..... 89/195
RE26,872 E * 4/1970 Preston ..... 89/195
4,649,800 A * 3/1987 Tessier ..... 89/194
4,769,938 A * 9/1988 Chesnut et al. ..... 42/76.02
4,947,730 A 8/1990 Byron
5,195,226 A 3/1993 Bornancini
5,216,191 A * 6/1993 Fox ..... 42/70.05
2006/0037464 A1* 2/2006 Moore ..... 89/125

FOREIGN PATENT DOCUMENTS

EP 0 607 463 A 7/1994

* cited by examiner

*Primary Examiner*—Michael Carone
*Assistant Examiner*—Michael D David
(74) *Attorney, Agent, or Firm*—Martin Fleit; Paul D. Bianco; Fleit Gibbons Gutman Bongini & Bianco PL

(57) ABSTRACT

The invention concerns a pistol with a housing (1), breech part (4) movable relative to housing (1), a barrel (5) arranged within breech part (4) and a trigger system (14, 15 16). The housing (1) according to the invention contains a receiver (2) and an upper housing part (3) designed in one part with it, which encloses the breech part (4) with the barrel (5) arranged in it.

6 Claims, 6 Drawing Sheets

PISTOL

FIELD OF THE INVENTION

The invention relates to a pistol, and more particularly to a pistol including a one-part housing in which all functional parts of the pistol are accommodated.

BACKGROUND OF THE INVENTION

Conventionally designed pistols generally have a breech in the form of an exposed slide, which is movably arranged on a receiver in the longitudinal direction. The receiver, consisting of metal or plastic, serves to receive the magazine and as a support for the complete trigger device, various operating elements and the control and guide elements for the slide movably on the receiver, which again functions as a support for the barrel, the firing pin and various safety and operating elements. However, the breech in such pistols must be manufactured extremely precisely and is also subjected to relatively demanding surface machining and surface treatment, since it is exposed and significantly determines the overall visual appearance of the piston. This is connected with high manufacturing expense. There is also a hazard of injury from the exposed breech on the receiver. Thus, the shooter's hand can be injured by the returning slide or particularly the hot combustion gases; during destruction of the breech there can be an increased hazard to the shooter in the face area or the like. In addition, ordinary pistols have a relatively high total weight. A large number of components are also necessary for a functionally capable pistol, and tolerance problems between the functional elements in the receiver and the corresponding functional elements in the breech can occur.

The problem of the invention is to devise a pistol of the type just mentioned in which the aforementioned problems can be avoided.

This problem is solved by a pistol of the present invention. Expedient modifications and advantageous variants of the invention are objects of the dependent claims.

SUMMARY OF THE INVENTION

All functional parts are integrated in a one-part housing in a piston according to the invention. The housing accommodates all functional parts so that the tolerance problems can be minimized. The pistol contains no elements moved by the firing impulse outside of the housing, which significantly reduces the hazard of injury. Even the breech part moved during shooting is completely enclosed by the housing and poses no hazard. The housing of the pistol can be manufactured cost-effectively and the number of components required for functional capability of the pistol can also be reduced. The pistol also has a uniform appearance without visible material transitions and without visible separation lines between the receiver and breech part. Since the breech part is enclosed by the housing and therefore not visible from the outside, it need not be subjected to surface machining, so that the manufacturing costs can be reduced.

In a lightweight and cost-effective variant the housing is made of plastic. The total weight of the pistol can be reduced and the handling improved by a plastic housing. However, the housing can also be made from light metal or another appropriate material.

The trigger guard is also molded onto the one-part housing. The rear sight and front sight can also be made in a simple variant in one piece of the housing. Mounting elements, for example, a Picatinny rail or the like for attachment of targeting aids or other accessories can also be molded onto the housing.

A mount open on the front side and closed on the back side is expediently provided in the upper part of the housing in which the breech part is movably in its longitudinal direction.

In another expedient, variant lateral openings are provided in the housing for repeater strips. The breech part arranged within the housing can be pushed rearward for manual cocking of the pistol via these repeater strips.

BRIEF DESCRIPTION OF THE DRAWINGS

Additional details and advantages of the invention are apparent from the following description of a preferred practical example by means of the drawing. In the drawing.

DETAILED DESCRIPTION OF THE INVENTION

Figure 1:
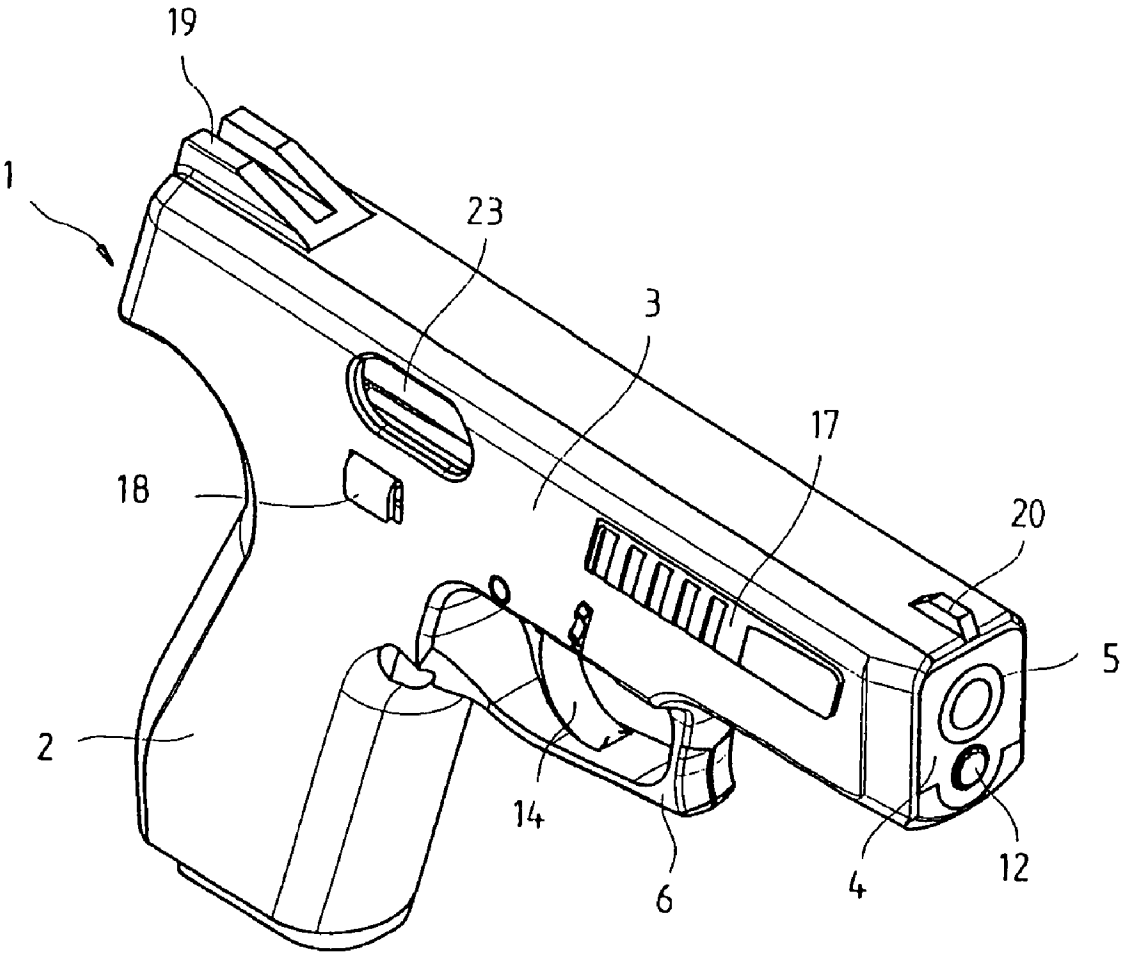
FIG. 1 shows a pistol in a schematic perspective viewed from the right in the firing direction.

The pistol depicted schematically in FIGS. 1 to 6 contains a one-part housing 1 preferably consisting of plastic, in which all the functional parts of the pistol are accommodated. The housing 1 contains a receiver 2 and an upper housing part 3 designed in one part with it, which encloses a breech part 4 with a barrel 5 arranged in it. A trigger glide 6 is also molded onto housing 1.

Figure 3:
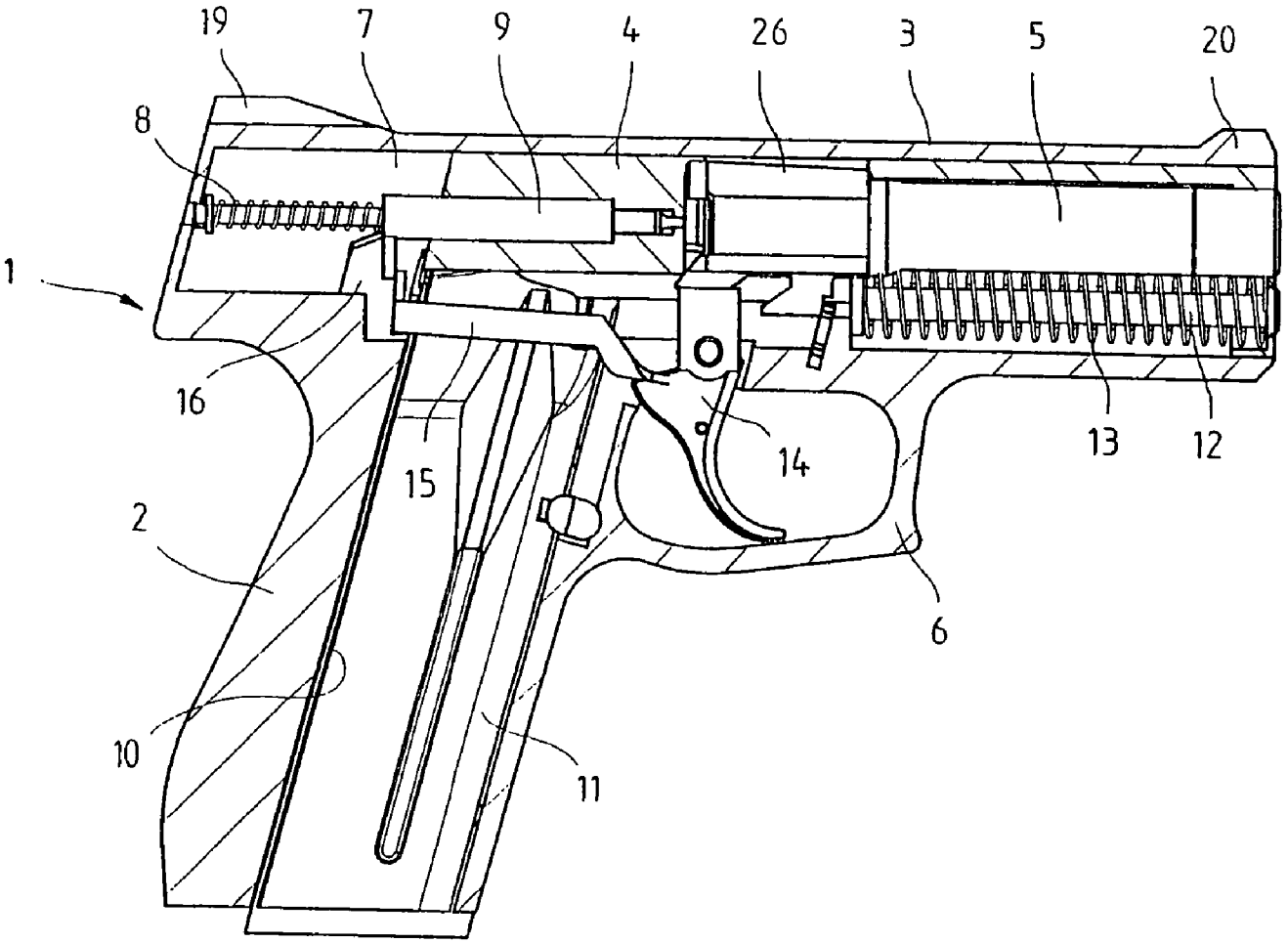
FIG. 3 shows the pistol of FIGS. 1 and 2 in a cutaway side view.
Figure 6:
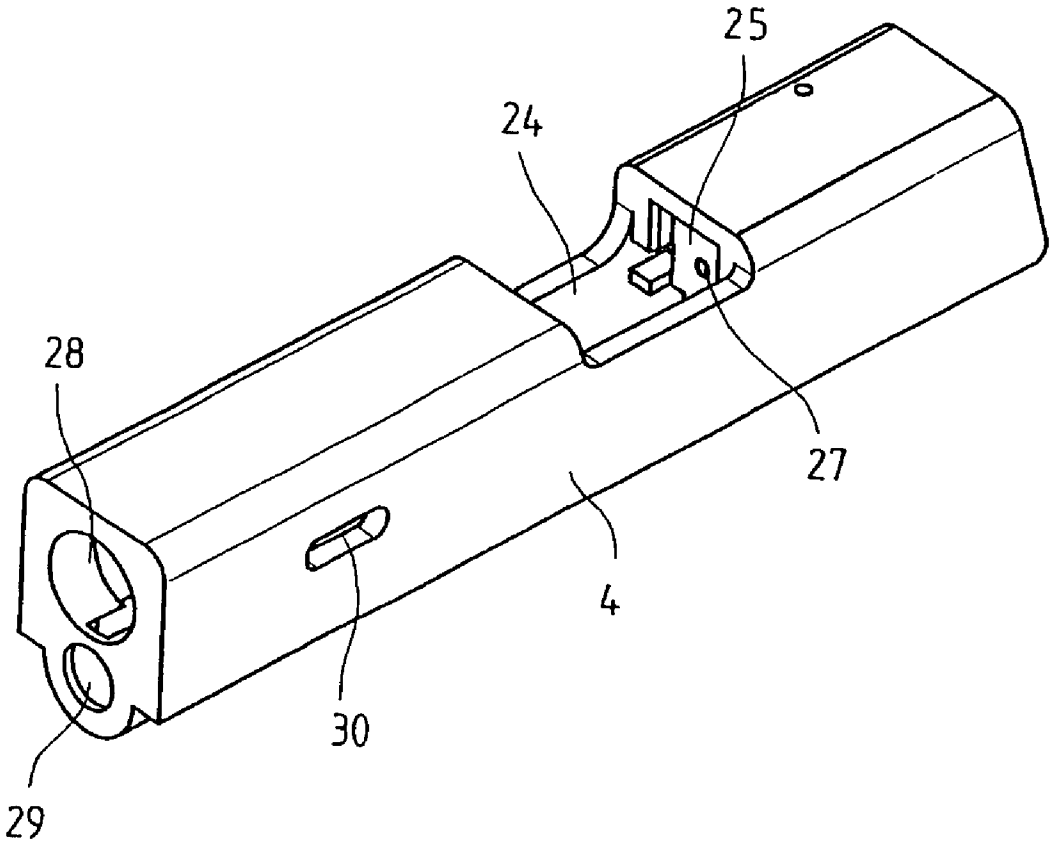
FIG. 6 shows a breech part of the pistol depicted in FIGS. 1 and 2 in a perspective view.

As follows in particular from FIG. 3, the upper housing part 3 has a mount 7 opened to the front and closed to the rear, in which the breech part 4 depicted separately in FIG. 6 is movably with the barrel 5 arranged in it. A firing pin 9 biased by a firing pin spring 8 is movably arranged in the breech part 4. A magazine shaft 10 to accommodate a magazine 11 is provided in receiver 2. Beneath barrel 5 a closure spring 13 guided on a closure spring guide 12 is arranged in the upper part of the housing 3 of housing 1. A trigger mechanism with a trigger 14, a trigger rod 15 and a release lever 16 as well as the various control and operating elements are also accommodated in housing 1.

Figure 2:
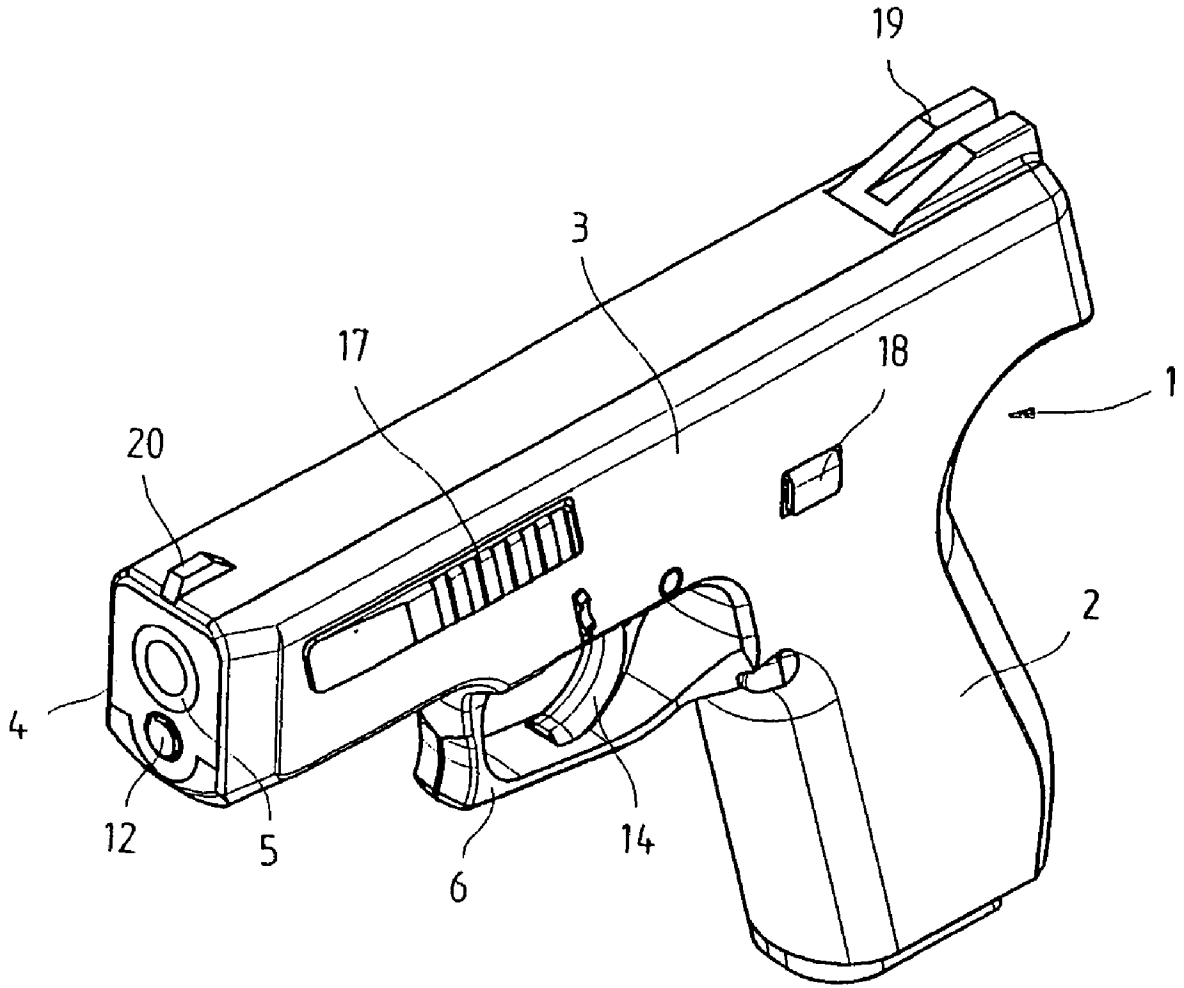
FIG. 2 shows the pistol of FIG. 1 in a schematic perspective viewed from the left in the firing direction.

In FIGS. 1 and 2 repeater strips 17 provided on both sides of housing 1 and a slide stop 18 operable from both sides are shown. The breech part 4 can be moved rearward via the repeater strip 17 for manual cocking. A rear sight 19 and front sight 20 are provided on the top of housing 1. In the variant depicted here the rear sight 19 and front sight 20 are also made in one part with housing 1. However, they can also be separate, optionally replaceable parts.

Figure 4:
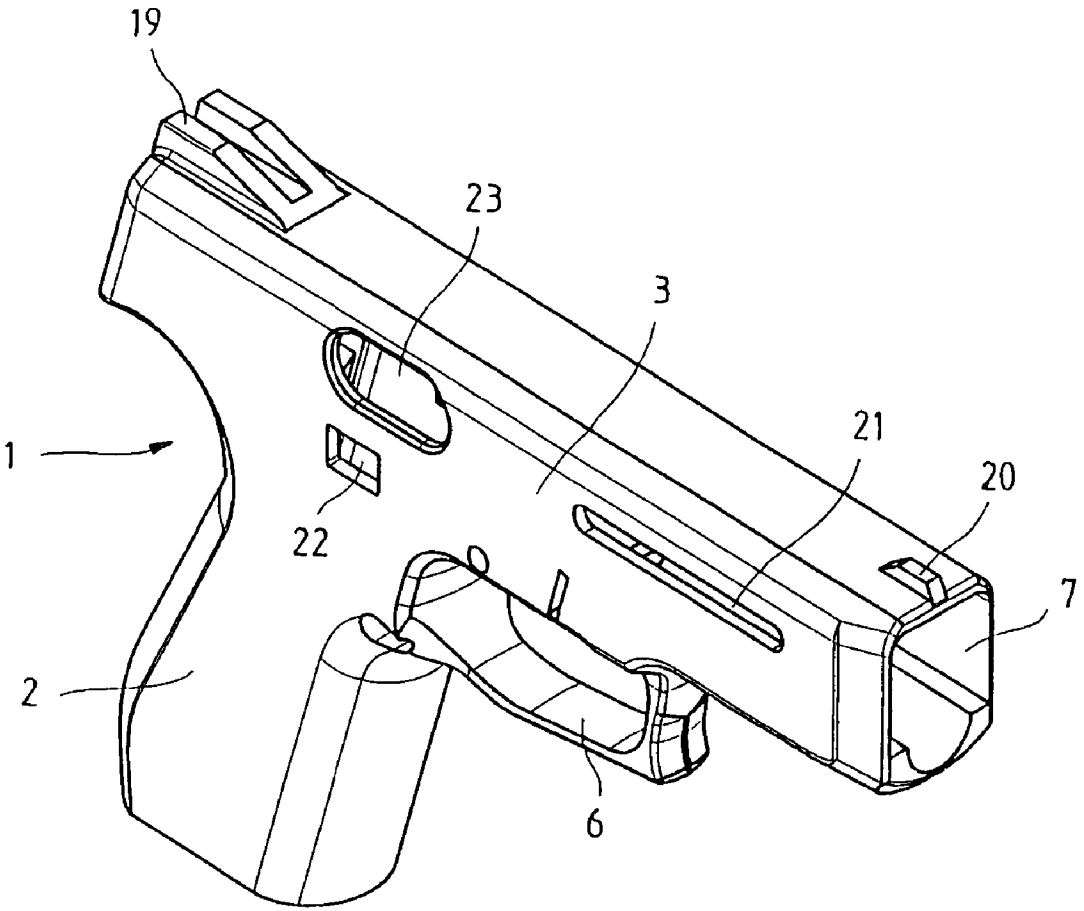
FIG. 4 shows the housing of the pistol depicted in FIGS. 1 and 2 in a perspective view from the right in the firing direction.
Figure 5:
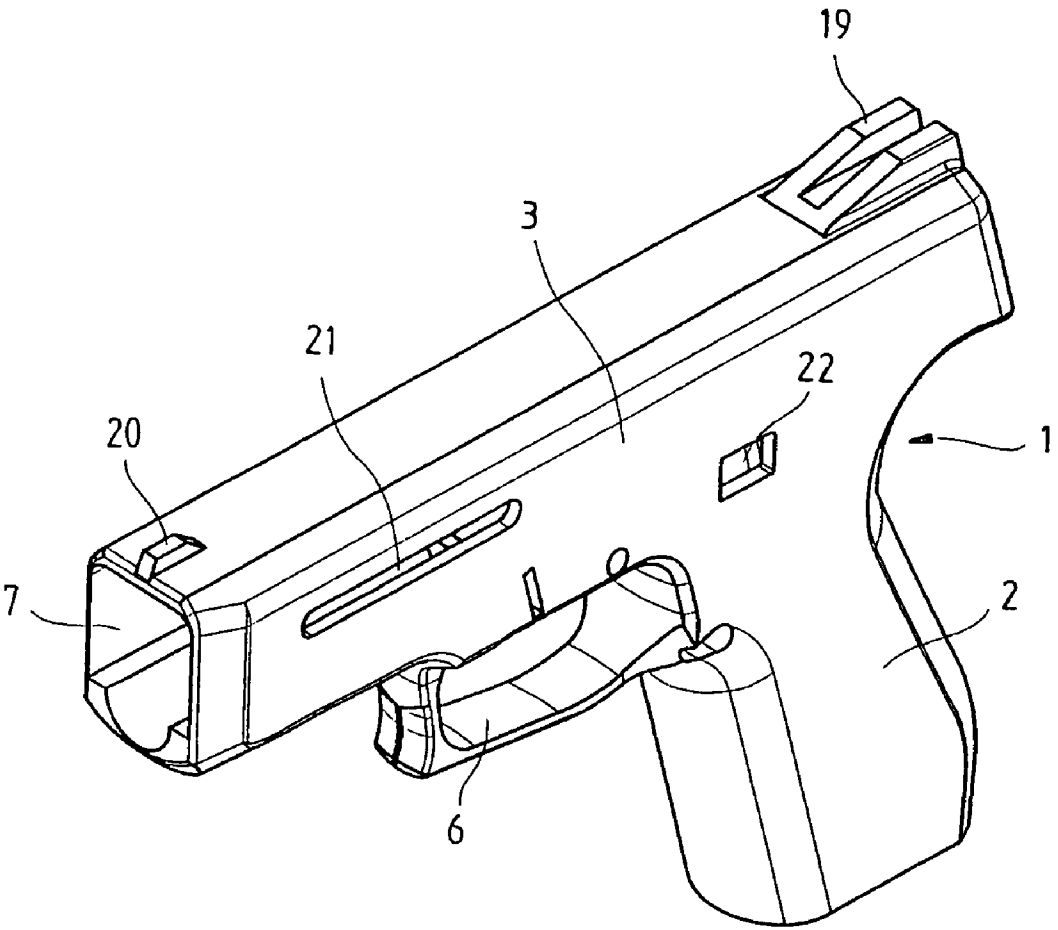
FIG. 5 shows the housing of the pistol depicted in FIGS. 1 and 2 in a perspective view from the left in the firing direction.

This follows from FIGS. 4 and 5, the housing 1 has lateral openings 21 for the repeater strips 17 and lateral openings 22 for the slide stop 18 next to the mount 7 for the breech part 4 accessible from the front. An ejection opening 23 for the spent cartridges is also provided on the side of housing 1 depicted in FIG. 4.

The breech part 4 movable in the longitudinal direction within the mount 7 of housing 1 is shown in FIG. 6. It contains an ejection opening 24 and an internal breech face 25 through which the cartridge chamber 26 of barrel 5 depicted in FIG. 3 is closed to the rear. An opening 27 is situated in breech face 25 for the firing pin 9 depicted in FIG. 3. The breech part 4 also contains next to a front barrel opening 28 a mounting hole 29 arranged beneath it for the closure spring guide 12 depicted in FIG. 3. Lateral slits 30 for the repeater strip 17 are introduced into the breech part 4.

The method of operation of the pistol just described corresponds to that of a locked recoil repeater. The pistol can be manually cocked to release the first shot via the repeater strip 17. After release of the first shot the weapon is automatically repeated by the gas pressure.

The invention is not restricted to the pistol described above and depicted in the figures. The pistol can be designed, for example, both as a locked and unlocked recoil repeater or gas pressure repeater.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A pistol comprising:

an outer frame designed in one part and consisting essentially of plastic the outer frame having an upper housing, a handle, and a trigger guard a breech part disposed within the upper housing and enclosed by the outer frame; and a barrel enclosed within the breech part, wherein the breech part is movable within the outer frame, and wherein the upper housing contains a mount having an open front and closed rear in which the breech part is guided to move in a longitudinal direction.

2. A pistol according to claim 1, wherein the housing outer frame contains a molded-on trigger guard.

3. A pistol according to claim 1, wherein the housing outer frame contains lateral openings for repeater strips.

4. A pistol according to claim 1, wherein the housing outer frame has lateral openings for a slide stop.

5. A pistol according to claim 1, wherein an election opening for spent cartridges is provided in housing the outer frame.

6. A pistol according to claim 1, wherein a rear sight and a front sight are molded onto the outer frame.

* * * * *